US009018501B2

(12) United States Patent
Tanabe et al.

(10) Patent No.: US 9,018,501 B2
(45) Date of Patent: Apr. 28, 2015

(54) STRING LOCKING STRUCTURE FOR ELECTRIC GUITAR AND TAILPIECE

(75) Inventors: Kazuma Tanabe, Nagano (JP); Shinichi Kuroiwa, Nagano (JP)

(73) Assignee: Fujigen Inc., Nagano (JP)

( * ) Notice: Subject to any disclaimer, the term of this patent is extended or adjusted under 35 U.S.C. 154(b) by 0 days.

(21) Appl. No.: 14/240,773

(22) PCT Filed: Aug. 31, 2011

(86) PCT No.: PCT/JP2011/004888

§ 371 (c)(1),
(2), (4) Date: Feb. 25, 2014

(87) PCT Pub. No.: WO2013/030895

PCT Pub. Date: Mar. 7, 2013

(65) Prior Publication Data

US 2014/0174275 A1 Jun. 26, 2014

(51) Int. Cl.

| | |
|---|---|
| ***G10D 3/12*** | (2006.01) |
| ***G10D 3/00*** | (2006.01) |
| ***G10D 1/08*** | (2006.01) |

(52) U.S. Cl.
CPC .. *G10D 3/00* (2013.01); *G10D 1/08* (2013.01); *G10D 3/12* (2013.01)

(58) Field of Classification Search
CPC ..... G10D 3/12; G10D 3/00; G10D 1/08
See application file for complete search history.

(56) References Cited

U.S. PATENT DOCUMENTS

| | | | | |
|---|---|---|---|---|
| 2,585,661 | A * | 2/1952 | Kluson | 84/299 |
| 4,138,919 | A * | 2/1979 | Miller | 84/297 R |
| 4,202,240 | A * | 5/1980 | Smith | 84/297 R |
| 6,818,814 | B2 * | 11/2004 | Park | 84/298 |
| 7,154,032 | B2 * | 12/2006 | Burchfield | 84/304 |
| 7,394,005 | B1 * | 7/2008 | Anderson et al. | 84/297 R |
| 7,465,858 | B2 * | 12/2008 | Beckwith | 84/267 |
| 8,895,823 | B2 * | 11/2014 | Musel | 84/299 |
| 2002/0104428 | A1 | 8/2002 | Wilson | |

(Continued)

FOREIGN PATENT DOCUMENTS

| | | | |
|---|---|---|---|
| JP | H03-116095 | A | 5/1991 |
| JP | 2005-195954 | A | 7/2005 |
| JP | 2007-537471 | A | 12/2007 |

OTHER PUBLICATIONS

International Search Report for PCT/JP2011/004888, Sep. 27, 2011.

*Primary Examiner* — Robert W Horn

(57) ABSTRACT

A string locking structure for an electric guitar is provided with a first string passing path and a second string passing path that are formed in a tailpiece, and a body-side string passing hole that is formed in a body. The first string passing path is a through-hole extending from a front surface part to a rear surface part of a tailpiece body member. A first half part of the second string passing path is a path shared with a first half part of the first string passing path, and a latter half part thereof is a through-hole curved at a right angle and leading to a bottom surface part of the tailpiece body member and communicates with the body-side string passing hole. Each string can be locked in two modes: a first string locked mode in which the string is passed through the first string passing path of the tailpiece and locked, and a second string locked mode in which the string is passed by way of the tailpiece attached to the surface of the body from the back surface side of the body.

5 Claims, 6 Drawing Sheets

(56) References Cited

U.S. PATENT DOCUMENTS

| | | | | |
|---|---|---|---|---|
| 2004/0129129 | A1 | 7/2004 | Wilson | |
| 2005/0072289 | A1 | 4/2005 | Butler | |
| 2005/0150348 | A1 | 7/2005 | Ito | |
| 2006/0070508 | A1 | 4/2006 | Butler et al. | |
| 2007/0214933 | A1 | 9/2007 | Adams | |
| 2008/0006140 | A1 | 1/2008 | Adams | |
| 2008/0271586 | A1 | 11/2008 | Adams | |
| 2008/0282869 | A1 | 11/2008 | Adams | |
| 2014/0174275 | A1* | 6/2014 | Tanabe et al. | 84/297 R |
| 2014/0311317 | A1* | 10/2014 | Gray et al. | 84/298 |

* cited by examiner

STRING LOCKING STRUCTURE FOR ELECTRIC GUITAR AND TAILPIECE

TECHNICAL FIELD

The present invention relates to a string locking structure for an electric guitar, and particularly relates to a string locking structure for an electric guitar in which a string can be locked in two string-locking modes using a tailpiece.

BACKGROUND ART

In an electric guitar, e.g. a Les-Paul-type of guitar, a string is passed through a string through-hole formed in a tailpiece attached to the surface of a body, the end of the string, called the ball end, is hitched into the opening of the string through-hole, the other end of the string is wound around a peg in the head side, and the string is pulled taut with a predetermined amount of tension. The bridge disposed on the head side relative to the tailpiece has a function as a fulcrum of string oscillation when the string is plucked, a fine-tuning function of intervals tuned with the peg, a function of adjusting the height of the bridge itself in order to adjust the height of the string from the fret board, and other functions.

Patent Document 1 discloses a string locking structure for an electric guitar that uses a tailpiece. In Patent Document 1, strings are passed through holes formed in a fixed plate of a tremolo block, the ball ends of the strings are locked in portions of large inside diameters formed in the rear ends of the holes, and the fixed plate functions as a tailpiece. The holes for passing the strings through the fixed plate are linear through-holes extending from the front surface to the rear surface. Patent Document 2 discloses a string locking structure using a bridge having an integrated tailpiece, in which a string through-hole extending linearly in the longitudinal direction of the guitar is formed in the bridge.

PRIOR ART DOCUMENTS

Patent Documents

[Patent Document 1] JP-A 2007-537471
[Patent Document 2] JP-A 2005-195954

DISCLOSURE OF THE INVENTION

Problems to be Solved by the Invention

A tailpiece used in order to lock the strings of an electric guitar in conventional practice commonly has a configuration in which six string through-holes are formed extending linearly in the longitudinal direction of the guitar, and there have been no proposals for a tailpiece having a function of locking a string in different string-locking modes, e.g. string-locking modes of different string length.

In view of these points, an object of the present invention is to provide a string locking structure for an electric guitar in which a string can be locked in two different string-locking modes using a tailpiece, and to provide a tailpiece suitable for configuring this string locking structure.

Means to Solve the Problems

To solve the problems described above, according to the present invention, there is provided a string locking structure for an electric guitar in which the rear ends of a plurality of strings are locked using a tailpiece attached to a surface of a body of the electric guitar; the string locking structure characterized in that:

the tailpiece is formed with a plurality of first string passing paths that extend through the tailpiece and that are parallel to each other, and formed with a plurality of second string passing paths that extend through the tailpiece and that are parallel to each other;

the first string passing paths extend linearly from first front-end openings exposed in a front surface portion that faces toward the head of the electric guitar within the tailpiece, up to first rear-end openings exposed in a rear surface portion that faces the opposite direction from the front surface portion;

the second string passing paths extend at a curve from second front-end openings exposed in the front surface portion of the tailpiece up to second rear-send openings exposed in a bottom surface portion in contact with the surface of the body within the tailpiece;

the body is formed with a plurality of parallel body-side string through-holes leading from front surface openings exposed in the surface of the body to rear surface openings exposed in the rear surface of the body;

the front surface openings of the body-side string through-holes communicate with the respective second rear-end openings of the second string passing paths; and the strings can be set to one of two string-locking modes: a first string-locking mode in which the strings are passed through the first string passing paths from the rear side of the tailpiece and ball ends on the rear ends of the strings are locked in the first rear-end openings of the first string passing paths, and a second string-locking mode in which the strings are passed sequentially through the body-side string through-holes and the second string passing paths from the rear surface side of the body and the ball ends in the rear ends of the strings are locked in the rear surface openings of the body-side string through-holes.

In the string locking structure for an electric guitar of the present invention, the strings can be locked in two string-locking modes; i.e., the second string-locking mode in which the strings are passed from the rear surface side of the body through the tailpiece attached to the front surface, and the first string-locking mode in which the strings are passed through and locked to the tailpiece similar to conventional practice. Because the body-side string through-holes formed in the guitar body are obscured by the tailpiece, the strings can be locked in the two string-locking modes without changing the appearance of the front surface of the guitar body.

It is sufficient merely to form the second string passing paths in the existing tailpiece provided with the first string passing paths and to form the body-side string through-holes in the body, and there is no need to manufacture or attach new components. Consequently, two string-locking modes can be achieved with a simple configuration without inducing large increases in manufacturing costs or manufacturing steps.

Furthermore, in the second string-locking mode, because the strings are passed through the body-side string through-holes formed in the body, string oscillation can be transferred more efficiently to the guitar body in comparison with the first string-locking mode in which the strings are locked to the tailpiece, whereby more harmonic overtones can be achieved.

Furthermore, the string length is longer in the second string-locking mode than in the first string-locking mode. Due to the second string passing paths being shaped so as to curve from the front surface portion of the tailpiece toward the bottom surface portion, a large amount of tensile force can be imparted to the strings by supporting the strings on the curved portions of the second string passing paths. As a result, when the guitar is tuned down, the strings can be maintained in a state of tension of greater tensile force in comparison to the first string-locking mode, and the tuned-down guitar can be played without stress.

It is simple to machine the holes when the second string passing paths are opened perpendicular to the first string passing paths, but the second string passing paths can also be formed so as to be inclined relative to the first string passing paths at an angle less than 90 degrees. The tensile force imparted to the strings can be varied by varying the angle of incline.

Next, the present invention is directed to a tailpiece used in the string locking structure for an electric guitar described above, characterized in comprising:

a tailpiece main body member;

a plurality of first string passing paths for locking the strings, the first string passing paths extending through the tailpiece main body member and being parallel to each other; and a plurality of second string passing paths for locking the strings, the first string passing paths extending through the tailpiece main body member and being parallel to each other; and when the tailpiece main body member has been attached to the front surface of the body of the electric guitar, the first string passing paths extending linearly from first front-end openings exposed in the front surface portion facing toward the head of the electric guitar within the tailpiece main body member up to first rear-end openings exposed in the rear surface portion facing the opposite direction from the front surface portion, and the second string passing paths extending at a curve from second front-end openings exposed in the front surface portion up to second rear-send openings exposed in the bottom surface portion in contact with the front surface of the body.

MODE FOR CARRYING OUT THE INVENTION

Figure 1:
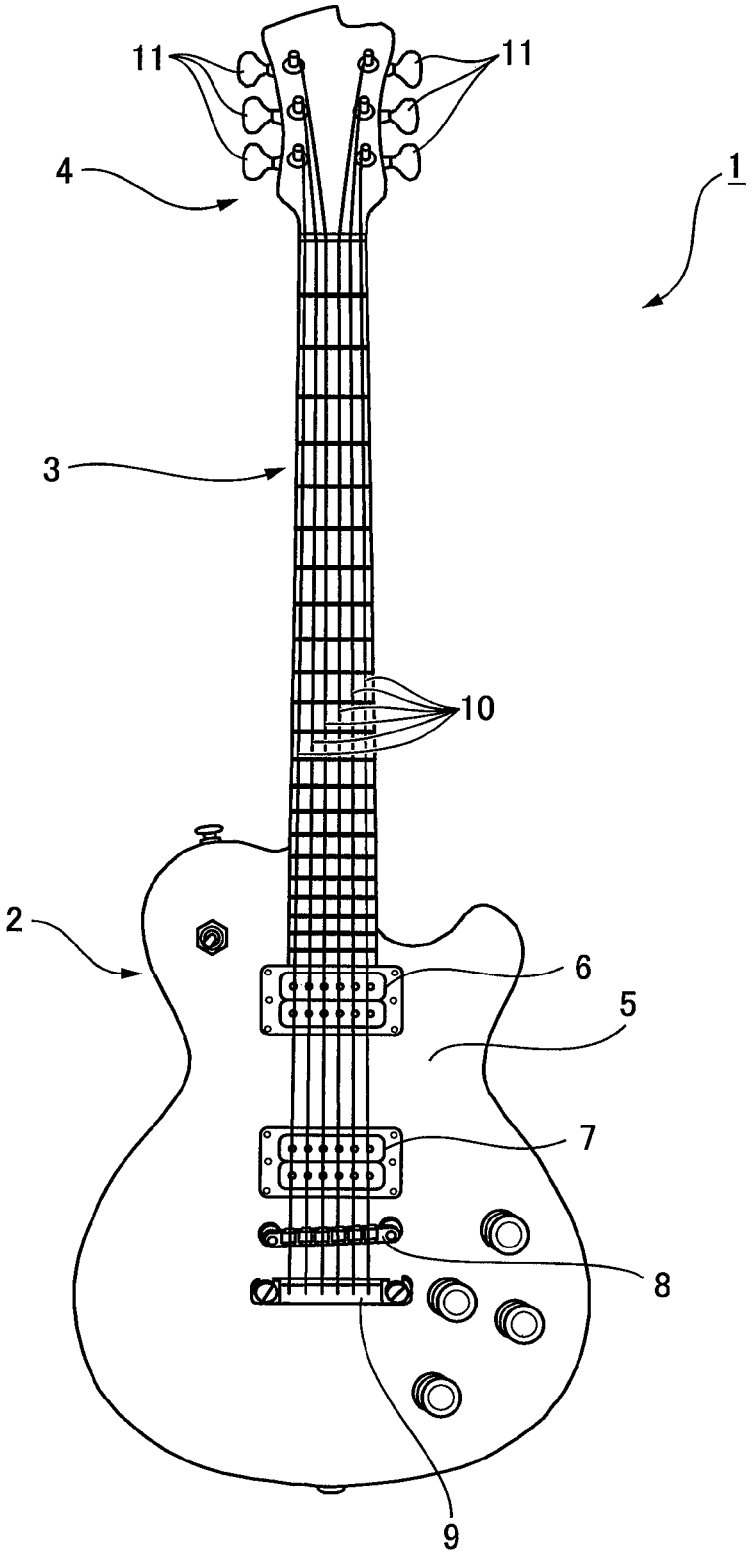
FIG. 1A front view showing an example of a Les-Paul-type electric guitar to which the present invention is applied.

An embodiment of an electric guitar to which the present invention is applied is described below with reference to the drawings. The basic configuration of a Les-Paul-type electric guitar 1 of the present invention is a common configuration having a body 2, a neck 3, and a head 4, and two pickups 6, 7, a bridge 8, and a tailpiece 9 are attached to a front surface 5 of the body 2 from the neck side, as shown in FIG. 1. Six strings 10 are locked at one end (the ball end) to the side of the tailpiece 9, and the other end of each string is wound around a peg 11 attached to the head 4.

Figure 2:
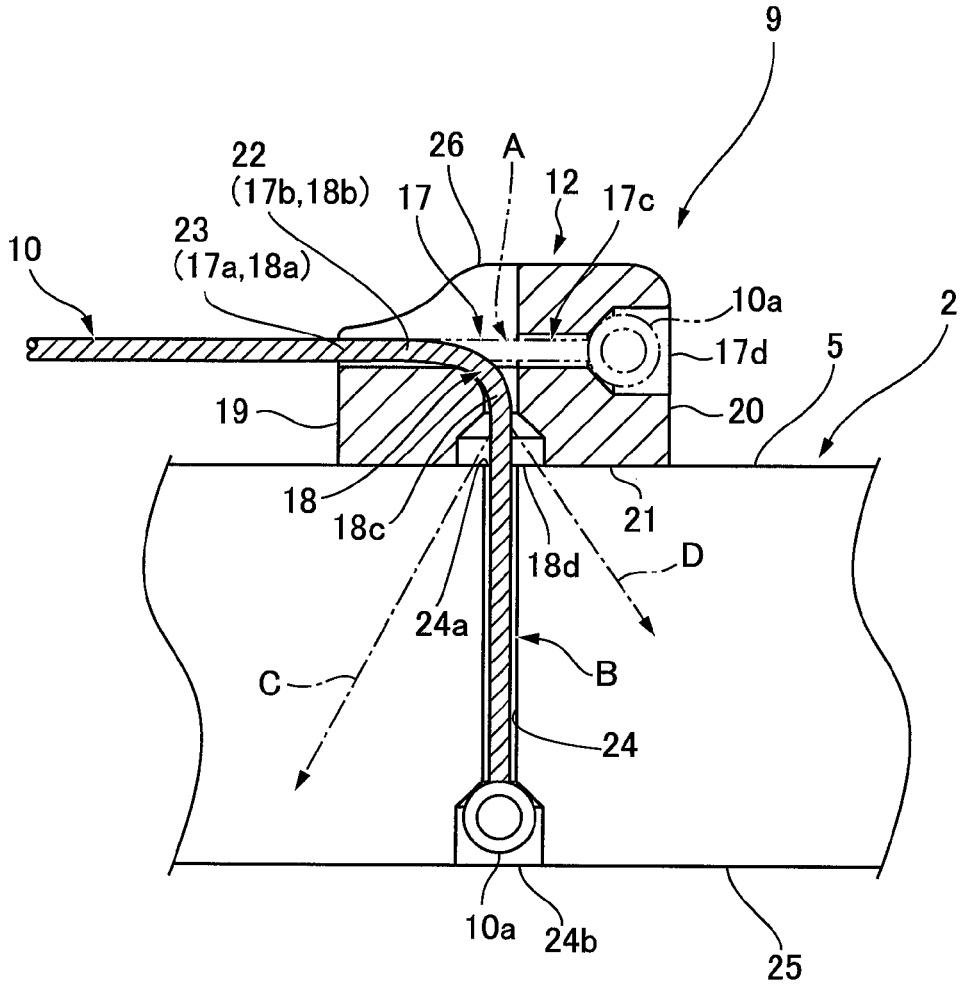
FIG. 2A schematic cross-sectional view showing a string locking structure that uses the tailpiece in the electric guitar of FIG. 1.
Figure 3:
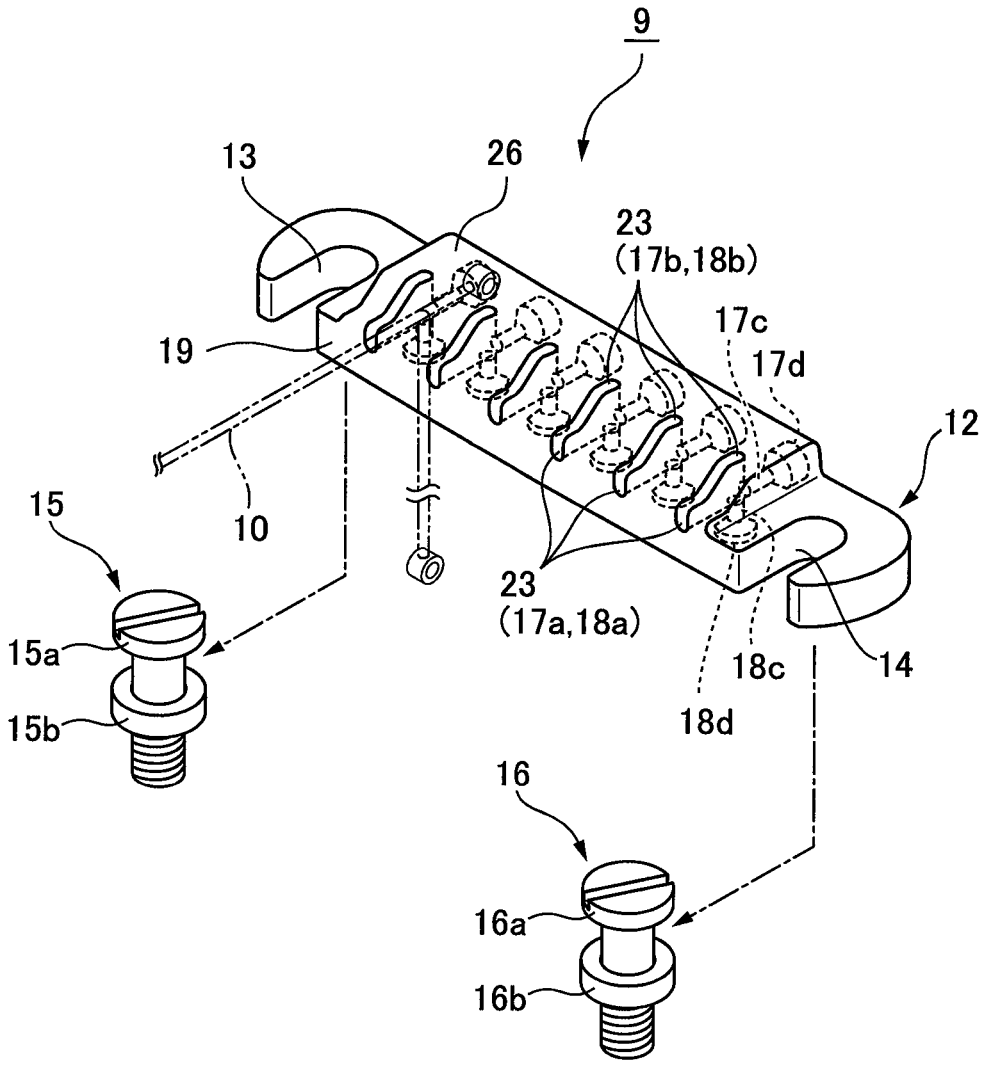
FIG. 3A perspective view showing the tailpiece of the electric guitar in FIG. 1.

FIG. 2 is a partial enlarged cross-sectional view of the electric guitar 1, showing the string locking structure in which the rear end of a string 10 is locked using the tailpiece 9 attached to the front surface 5 of the body 2. FIG. 3 is a perspective view of the tailpiece 9. Referring to these drawings, the tailpiece 9 is formed from a long, thin tailpiece main body member 12 made of metal. Bolt-fitting grooves 13, 14 opening toward the head 4 (forward) and upward are formed in both ends of the tailpiece main body member 12. The tailpiece main body member 12 is fixed to the front surface 5 of the body 2 by two tailpiece attachment bolts 15, 16 fitted in these bolt-fitting grooves 13, 14.

Specifically, the tailpiece attachment bolts 15, 16 are threaded through and fixed to nuts (not shown) embedded in advance in the body 2, and heads 15*a*, 16*a* of the bolts protrude from the front surface 5 of the body 2. Discoid flanges 15*b*, 16*b* are formed in positions at fixed gaps from the heads 15*a*, 16*a*, and the top surfaces of the flanges 15*b*, 16*b* are positioned at the same height as the front surface 5 of the body 2. The portions of the tailpiece 9 where the left and right bolt-fitting grooves 13, 14 are formed are inserted from the rear of the tailpiece attachment bolts 15, 16, in between the heads 15*a*, 16*a* and the flanges 15*b*, 16*b*.

Formed in the tailpiece main body member 12 are six first string passing paths 17 for locking strings that extend through the main body member and that are parallel to each other, and six second string passing paths 18 for locking strings that extend through the tailpiece main body member 12 that are parallel to each other. The string passing paths 17 are linear passing paths that lead from first front-end openings 17*a* exposed in a front surface portion 19 facing toward the head 4 of the electric guitar 1 in the tailpiece main body member 12, to first rear-end openings 17*d* exposed in a rear surface portion 20 facing the opposite direction of the front surface portion 19. The second string passing paths 18 are courses that lead from second front-end openings 18*a* exposed in the front surface portion 19 of the tailpiece main body member 12, to second rear-end openings 18*d* exposed in a bottom surface portion 21 in contact with the front surface 5 of the body 2 in the tailpiece main body member 12.

Each of the first string passing paths 17 comprises a first front-side string passing path portion 17*b* on the side of the first front-end opening 17*a*, and a first rear-side string passing path portion 17*c* on the side of the first rear-end opening 17*d*. Each of the second string passing paths 18 comprises a second front-side string passing path portion 18*b* on the side of the front-end opening 18*a*, and a second rear-side string passing path portion 18*c* on the side of the second rear-end opening 18*d*. In the present example, the first front-side string passing path portion 17*b* and the second front-side string passing path portion 18*b* constitute a shared front-side string passing path portion 22, and the first front-end opening 17*a* and second front-end opening 18*a* at the front ends thereof constitute a shared front-end opening 23. The first rear-side string passing path portion 17*c* of the first string passing path 17 is a linear continuation of the rear end of the front-side string passing path portion 22, but the second rear-side string passing path portion 18*c* of the second string passing path 18 extends linearly in a direction bent at a right angle from the rear end portion of the front-side string passing path portion 22.

A body-side string passing hole 24 is formed passing through the body 2 in the thickness direction. The body-side string passing hole 24 is a through-hole leading from a front surface opening 24*a* exposed in the front surface 5 of the body 2 to a rear surface opening 24*b* exposed in the rear surface 25 of the body 2. The front surface openings 24*a* of the body-side string passing holes 24 all communicate with respective second rear-end openings 18*d* of the second string passing paths 18 of the tailpiece main body member 12 attached to the front surface 5 of the body 2.

In the string locking structure of this configuration, the strings 10 can be passed through the first string passing paths 17 from the rear side of the tailpiece main body member 12, and locked in a first string locked state in which the ball ends 10*a* at the rear ends of the strings are locked in the first rear-end openings 17*d* of the first string passing paths 17, as shown by the imaginary line A in FIG. 2. The strings 10 can also be passed sequentially through the body-side string passing holes 24 and the second string passing paths 18 from the rear surface 25 of the body 2, and locked in a second string locked state in which the ball ends 10*a* at the rear ends of the strings are locked in the rear surface openings 24*b* of the body-side string passing holes 24, as shown by the solid line B in FIG. 2.

Figure 4:
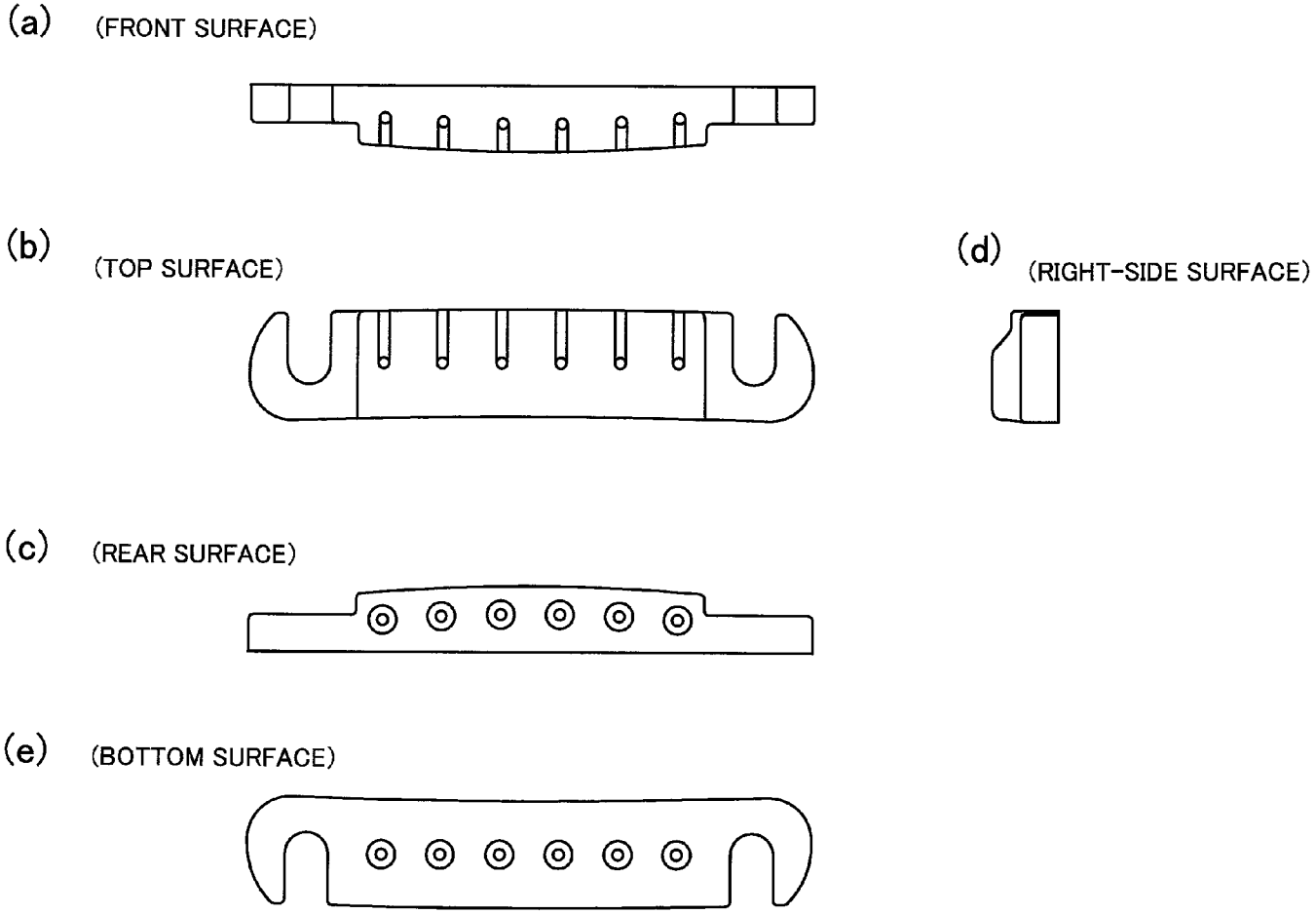
FIG. 4A front view, a plan view, a rear view, a right-side view, and a bottom view showing the tailpiece of FIG. 1.
Figure 5:
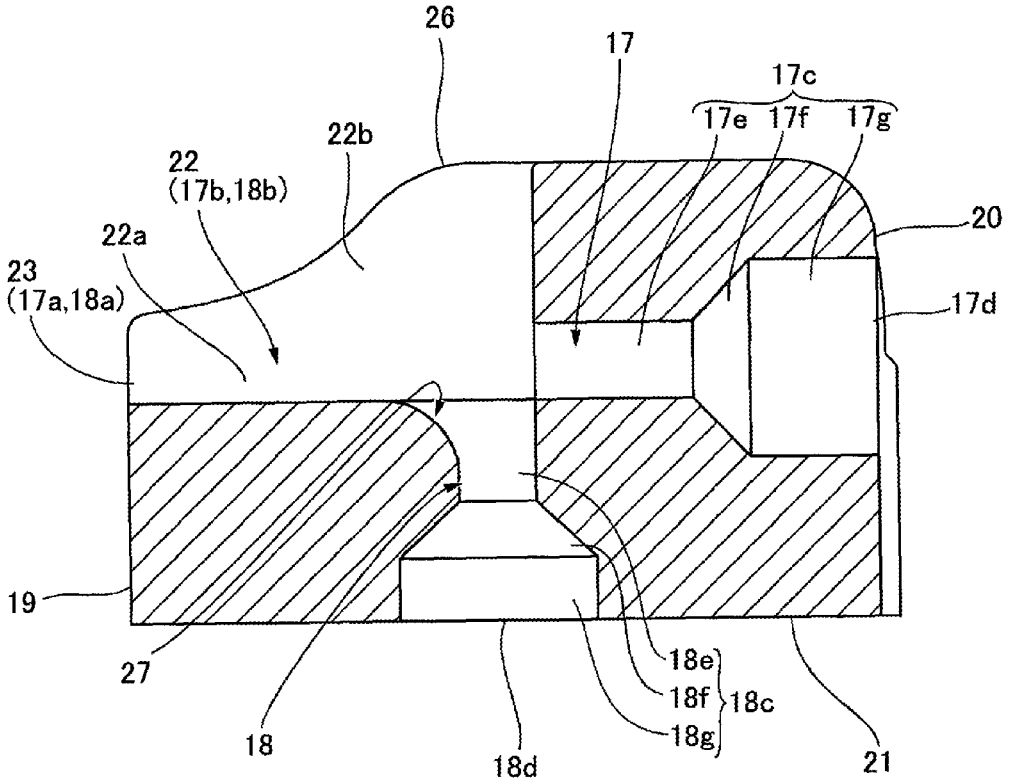
FIG. 5A cross-sectional view of the tailpiece of FIG. 1.

FIGS. 4(*a*) to (*e*) are, respectively, a front view, a plan view, a rear view, a right-side view, and a bottom view, all showing the tailpiece 9; and FIG. 5 is a cross-sectional view of the tailpiece 9. These drawings are used as references to describe the structure of each portion of the tailpiece 9 in detail.

As previously described, each first string passing path 17 is a through-path extending linearly and comprises a front-side string passing path portion 22 (a first front-side string passing path portion 17*b*) and a first rear-side string passing path portion 17*c*, the front end of the front-side string passing path portion 22 being joined to the front-end opening 23 (the first front-end opening 17*a*) of the front surface portion 19 of the tailpiece main body member 12, and the rear end of the first rear-side string passing path portion 17*c* being joined to the first rear-end opening 17*d* of the rear surface portion 20. The front-side string passing path portion 22 of the present example is a groove of fixed width opening in a top surface portion 26 of the tailpiece main body member 12, a groove bottom surface 22*a* thereof being defined by a semicircular curved surface, and left and right groove side surfaces 22*b* being defined by flat side surfaces extending perpendicular to the bottom surface portion 21 from the side edges of the groove bottom surface toward the top surface portion 26.

The first rear-side string passing path portion 17*c* is composed of a small-diameter hole portion 17*e* having the same curvature radius as the groove bottom surface 22*a*, a tapered hole portion 17*f* expanding as a continuation of the rear end thereof, and a large-diameter hole portion 17*g* continuing from the rear end thereof, the rear end of the large-diameter hole portion 17*g* being joined to the first rear-end opening 17*d*. The groove-shaped front-side string passing path portion 22 and the small-diameter hole portion 17*e* of the first rear-side string passing path portion 17*c* are larger than the outside diameter of the string 10 and smaller in diameter than the ball end 10*a*, and the ball end 10*a* of the string 10 can be inserted through the large-diameter hole portion 17*g* in the rear side.

The front-side portion of the second string passing path 18 constitutes the shared front-side string passing path portion 22 with the first string passing path 17, and the rear-side portion constitutes the second rear-side string passing path portion 18*c* bent at a right angle from the rear-end portion of the front-side string passing path portion 22 toward the bottom surface portion 21 and then extending linearly. The rear end of the second rear-side string passing path portion 18*c* is joined to the second rear-end opening 18*d* exposed in the bottom surface portion 21. The second rear-side string passing path portion 18*c* is composed of a small-diameter hole portion 18*e* having the same radius as the curvature radius of the groove bottom surface 22*a*, a tapered hole portion 18*f* expanding as a continuation of the rear end thereof, and a large-diameter hole portion 18*g* continuing from the rear end thereof, the rear end of the large-diameter hole portion 18*g* being joined to the second rear-end opening 18*d*. The small-diameter hole portion 18*e* of the second rear-side string passing path portion 18*c* is larger than the outside diameter of the string 10 and smaller in diameter than the ball end 10*a*, and the ball end 10*a* of the string 10 can be inserted through the large-diameter hole portion 18*g* in the rear side.

The small-diameter hole portion 18*e* of the second rear-side string passing path portion 18*c* opens in the rear end of the groove bottom surface 22*a* of the groove-shaped front-side string passing path portion 22. Between the rear end portion of the groove bottom surface 22*a* and the internal peripheral surface portion of the small-diameter hole portion 18*e* is a curved portion 27 where these two portions continue smoothly due to a convex curved surface, as can be seen in FIG. 5. In the second string-locking mode, the string 10 is locked in a state of being supported by the curved portion 27 (see FIG. 2).

In the tailpiece 9 of this configuration, the front half portions of the first string passing path 17 and the second string passing path 18 constitute the shared groove-shaped front-side string passing path portion 22. Therefore, after the string 10 is pulled out from the rear surface 25 of the body 2 through the second string passing path 18 to the top surface portion 26 of the tailpiece 9, the operation of pulling the string 10 out forward along the shared front-side string passing path portion 22 can easily be performed.

Other Embodiments

Figure 6:
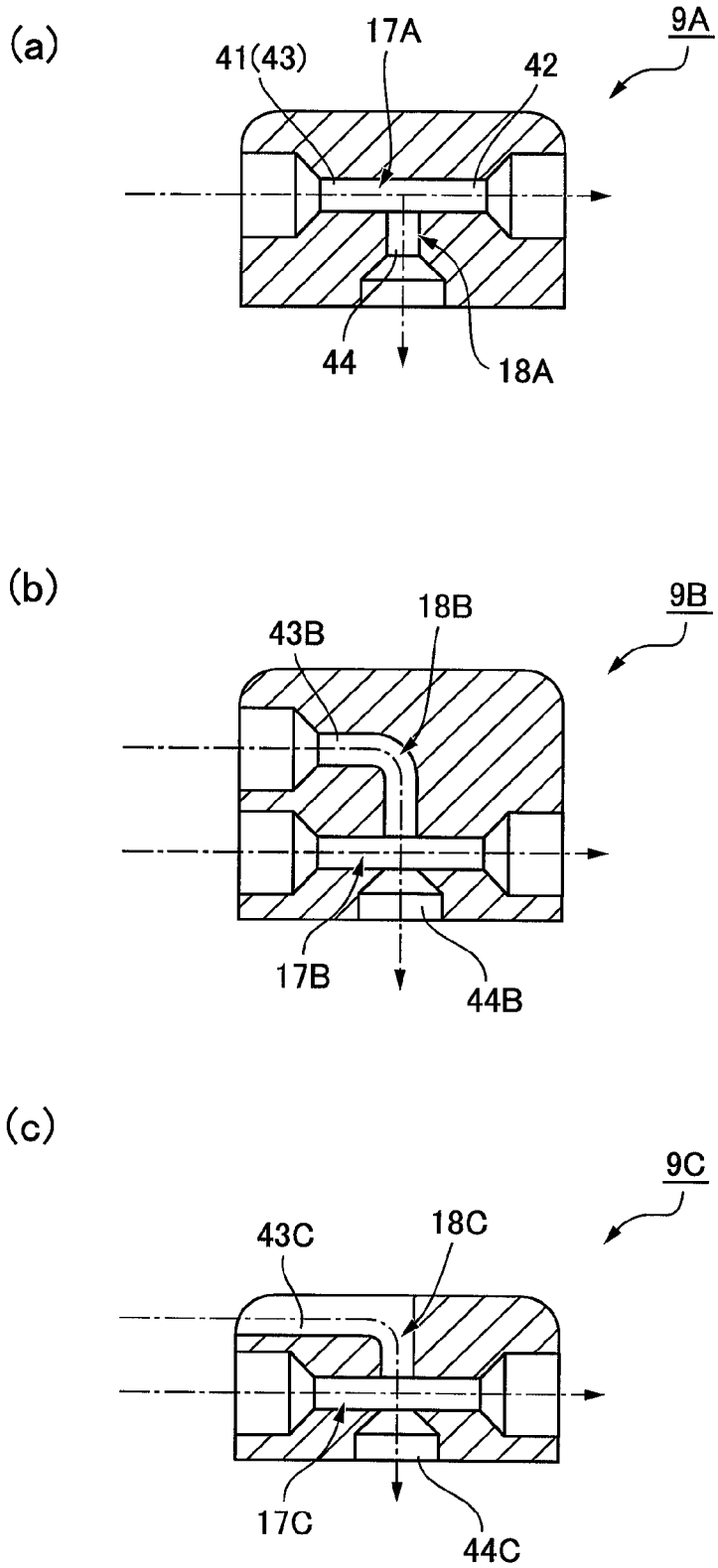
FIG. 6 An explanatory view showing a modification of the tailpiece.

FIGS. 6(*a*) to (*c*) are explanatory drawings showing modifications of the tailpiece 9 comprising the first string passing path 17 and the second string passing path 18. In the tailpiece 9A shown in FIG. 6(*a*), the first string passing path 17A is a linear through-hole having a circular cross section, comprising a front-side string passing hole portion 41 and a rear-side string passing hole portion 42. The second string passing path 18A comprises a front-side string passing hole portion 43 shared with the front-side string passing hole portion 41 of the first string passing path 17A, and a rear-side string passing hole portion 44. The rear-side string passing hole portion 44 is a linear branching hole portion having a circular cross section, that branches at a right angle from the region between the front-side string passing hole portion 41 and the rear-side string passing hole portion 42 in the first string passing path 17A.

In the tailpiece 9B shown in FIG. 6(*b*), the first string passing path 17B is a linear through-hole having a circular cross section. The second string passing path 18B comprises a front-side string passing hole portion 43B and a rear-side string passing hole portion 44B. The front-side string passing hole portion 43B is a hole having a circular cross section extending linearly nearer to the top surface portion than the first string passing path 17B, and the rear-side string passing hole portion 44B is a hole having a circular cross section that bends at a right angle from the rear end of the front-side string passing hole portion 43B toward the bottom surface portion and then extends linearly. The rear-side string passing hole portion 44B intersects the first string passing path 17B at a right angle at a position midway through.

The tailpiece 9C shown in FIG. 6(*c*) is basically the same as the tailpiece 9B shown in FIG. 6(*b*). In the tailpiece 9C, the first string passing path 17C is a linear through-hole having a circular cross section, and the second string passing path 18C comprises a front-side string passing hole portion 43C composed of a groove opening upward, and a rear-side string passing hole portion 44C having a circular cross section.

In the above examples, a rear-side string passing path portion of the second string passing path and a third string passing hole formed in the body extend in the thickness direction of the body, but these portions can also be formed so as to extend in a direction inclined relative to the thickness direction of the body. For example, these portions can be inclined at acute angles forward and backward relative to the thickness direction of the body, as indicated by the arrows C and D shown by the single-dash lines in FIG. 2. Making these portions to extend in the thickness direction of the body has the advantage of making hole machining easier. Inclining the holes makes it possible to adjust the tension applied to the string because the string length can be varied.

The invention claimed is:

1. A string locking structure for an electric guitar in which rear ends of a plurality of strings are locked using a tailpiece attached to a surface of a body of the electric guitar; the string locking structure characterized in that:

the tailpiece is formed with a plurality of first string passing paths and a plurality of second string passing paths, the first string passing paths extending through the tailpiece and parallel to each other, and the second string passing paths extending through the tailpiece and parallel to each other;

the first string passing paths extend linearly from first front-end openings exposed in a front surface portion of the tailpiece to first rear-end openings exposed in a rear surface portion of the tailpiece, the front surface portion facing toward a head of the electric guitar and the rear surface portion facing an opposite direction from the front surface portion;

the second string passing paths extend at a curve from second front-end openings exposed in the front surface portion of the tailpiece to second rear-end openings exposed in a bottom surface portion of the tailpiece, the bottom surface portion being in contact with the surface of the body;

the body is formed with a plurality of parallel body-side string passing holes leading from front surface openings exposed in the surface of the body to rear surface openings exposed in a rear surface of the body;

the front surface openings of the body-side string passing holes communicate with the respective second rear-end openings of the second string passing paths; and the strings can be set to one of first and second string-locking modes, wherein in the first string-locking mode, the strings are passed through the first string passing paths from a rear side of the tailpiece and ball ends on rear ends of the strings are locked in the first rear-end openings of the first string passing paths, and in the second string-locking mode, the strings are passed sequentially through the body-side string passing holes and the second string passing paths from the rear surface side of the body and the ball ends in the rear ends of the strings are locked in the rear surface openings of the body-side string passing holes.

2. A tailpiece for use in the string locking structure for an electric guitar according to claim 1, characterized in comprising:

a tailpiece main body member;

a plurality of first string passing paths for locking strings, the first string passing paths extending through the tailpiece main body member and being parallel to each other; and a plurality of second string passing paths for locking the strings, the second string passing paths extending through the tailpiece main body member and being parallel to each other; wherein when the tailpiece main body member is attached to a front surface of a body of the electric guitar, the first string passing paths extend linearly from first front-end openings to first rear-end openings within the tailpiece main body member, the first front-end openings being exposed in a front surface portion facing toward a head of the electric guitar, and the first rear-end openings being exposed in a rear surface portion facing an opposite direction from the front surface portion, and the second string passing paths extend at a curve from second front-end openings exposed in the front surface portion to second rear-end openings exposed in a bottom surface portion in contact with the front surface of the body.

3. The tailpiece according to claim 2, wherein each of the first string passing paths comprises a first front-side string passing path portion connected to the first front-end opening, and a first rear-side string passing path portion connected to the first rear-end opening, each of the second string passing paths comprises a second front-side string passing path portion connected to the second-end opening, and a second rear-side string passing path portion connected to the second rear-end opening, the first front-side string passing path portion and the second front-side string passing path portion form a shared front-side string passing path portion, and the first front-end opening and the second front-end opening form a shared front-end opening, and the second rear-side string passing path portion extends along an inclined direction with respect to the shared front-side string passing path portion.

4. The tailpiece according to claim 3, wherein the front-side string passing path portion is a groove having a constant width and opens in a top surface portion of the tailpiece main body member, the first rear-side string passing path portion is a hole having a circular section, the second rear-side string passing path portion is a hole having a circular section, the rear-side string passing path portion is exposed in a rear-end portion of a groove bottom surface of the front-side string passing path portion, and a curved portion having a convex curved surface is formed between a rear-end portion of the groove bottom surface and an inner peripheral surface portion of the second rear-side string passing path portion extending from the groove bottom portion, the curved portion smoothly connecting the rear-end portion and the inner peripheral surface portion.

5. The tailpiece according to claim 4, wherein the first string passing path extends linearly parallel to the surface of the body when the tailpiece main body member is attached on the surface of the body, and the second rear-side string passing path portion of the second string passing path extends perpendicular to the front-side string passing path portion.

* * * * *